United States Patent [19]

Jergenson

[11] Patent Number: 4,617,203

[45] Date of Patent: Oct. 14, 1986

[54] PREPARATION OF LIQUID METAL SOURCE STRUCTURES FOR USE IN ION BEAM EVAPORATION OF BORON-CONTAINING ALLOYS

[75] Inventor: Jerg B. Jergenson, Santa Barbara, Calif.

[73] Assignee: Hughes Aircraft Company, Los Angeles, Calif.

[21] Appl. No.: 721,336

[22] Filed: Apr. 8, 1985

[51] Int. Cl.[4] ..... B05D 3/02

[52] U.S. Cl. ..... 427/294; 427/376.7; 427/376.8; 427/443.2

[58] Field of Search ..... 427/376.7, 376.8, 443.2, 427/294

[56] References Cited

U.S. PATENT DOCUMENTS

| | | | |
|---|---|---|---|
| 2,659,685 | 11/1953 | Lafferty | 148/31.5 |
| 2,996,412 | 8/1951 | Alexander | 427/376.7 X |
| 3,369,920 | 2/1968 | Bourdeau et al. | 427/376.6 X |
| 3,503,118 | 3/1970 | Criscione et al. | 427/376.7 X |
| 3,549,408 | 12/1970 | Bonne | 427/376.7 X |

*Primary Examiner*—Thurman K. Page

*Attorney, Agent, or Firm*—Victor G. Laslo; A. W. Karambelas

[57] ABSTRACT

A process for preparing a liquid metal ion source structure, preferably made from graphite, so that it may be wetted with boron-containing alloys. The process first involves the coating the source structure with elemental boron. The boron is preferably furnished as boron powder in a liquid carrier which may then be coated onto the surface of the source structure substrate. The coated structure is heated for a short time to a temperature whereat the source structure substrate and boron form a liquid layer at the surface of the substrate to "boronize" the substrate. The final wetted source structure is achieved by mixing a small amount of free boron powder with the alloy to be ion evaporated (also in powdered form), coating the previously boronized source structure with this mixture and heating the contacted boron-augmented source alloy and source structure to a temperature of at least the solidus temperature of the source alloy, at which point the source structure is wetted. Once wetted, a flow of source alloy toward the emitter tip of the source structure can be established during operation of the ion source. Prior boronizing may be omitted for some boron carbide source structures.

17 Claims, 9 Drawing Figures

Fig. 4a.
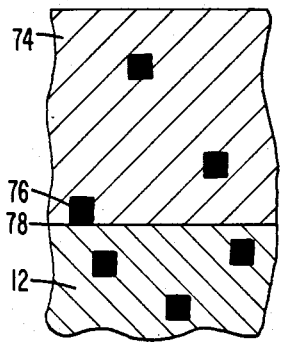
Fig. 4b
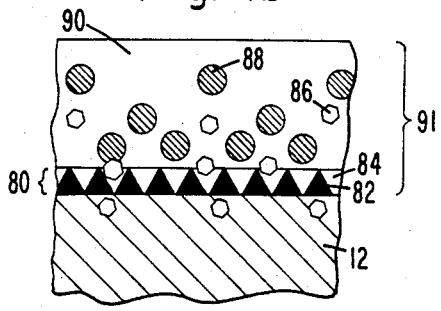
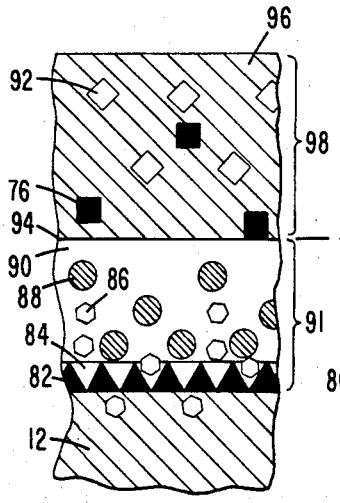
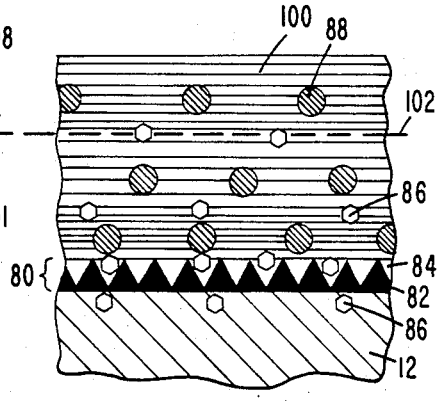
Fig. 5a.
Fig. 5b.

PREPARATION OF LIQUID METAL SOURCE STRUCTURES FOR USE IN ION BEAM EVAPORATION OF BORON-CONTAINING ALLOYS

The Government has rights in this invention pursuant to Contract No. 81-F-597000 awarded by the Department of the Air Force.

BACKGROUND OF THE INVENTION

1. Field of the Invention

This invention relates to liquid metal ion sources, and more particularly, to the wetting of boron bearing ion source alloys to portions of an ion source structure.

2. Description of Related Art

Liquid metal ion sources provide high current densities of ions from a source having a small virtual source size. A high brightness and small source size are required when the ion beam is to be focused with a high resolution of, for example, less than 1 micrometer spot size, and utilized in applications such as the fabrication of semiconductor microcircuits. The high current density and small virtual source size are achieved by emitting the ions from a source structure embodying a sharp point, such as the point of a needle. In one such approach, a needle is covered with a layer of liquid ion source metal, and a cusp in the liquid metal at the point of the needle is created by application of an electrostatic field. This fine cusp then becomes the emitting source for the extraction of ions. As the ions are emitted from the source, more liquid source metal must flow from the reservoir down the needle to the cusp to replenish that which has been extracted.

For this type of high brightness ion source to operate properly, the ion source alloy must wet the needle to ensure a smooth flow of metal from the reservoir to the cusp. If the ion source alloy does not wet the needle, ions cannot be extracted from the emitter tip. If the needle is incompletely wetted, flow of the liquid alloy may be insufficient to maintain a constant ion beam current, or flow may occur asymetrically resulting in the formation of an offset, illformed cusp. Such a cusp manifests itself as a large or non-circular source of ions. The presence of any of these problems results in poor performance of the source.

In some instances, ion source alloys naturally wet the needle. The wetting reaction may sometimes be so complete that the ion source alloy can rapidly corrode the wetted portions of the ion source structure, leading to a relatively short operating time before the ion source must be replaced. Such corrosion changes the geometry of the emitter tip as well as the composition of the alloy being ion evaporated, both effects serving to reduce the efficiency of the ion source. Obtaining a suitable material for making the wetted components of an ion source structure, typically, involves balancing the properties of sufficient wetting of the structure by the source alloy to attain metal flow during ion evaporation, and the inhibition of adverse corrosive effects. Briefly, raising the ion source temperature above the normal operating temperature of the source often improves the wetting, but this approach is of limited use because of the associated increase in corrosion rate at elevated temperatures as well as the increased rate of loss of volatile elements which may be present in the ion source alloy.

The ion evaporation of boron from boron-containing source alloys is particularly important in the field of doping by ion implantation in silicon semiconductors. Molten alloys containing the metalloid boron do not wet many candidate emitter materials thoroughly, and corrosively attack most that are wetted.

Boron is typically ion evaporated from boron-platinum, boron-palladium, boron-nickel, boron-containing ternary alloys or more complex alloys containing boron. Boron-platinum alloys have been used for sometime with ion source structures whose wetted components are composed of pure rhenium. An average lifetime of 10 hours is realized with such a combination. The source structure ultimately fails because of the gradual formation of the ternary alloy boron-platinum-rhenium, which requires a constantly increasing temperature in order to maintain liquidity. The entire structure finally becomes unstable so that either the tip of the emitter is pulled off by the electrostatic field or the heater-reservoir burns out.

In another approach, a glassy carbon emitter needle is used to ion evaporate boron from nickel-boron alloys, with the source having a usable lifetime of about 50–90 hours. It has been reported, however, that the nickel constituent of the ion source alloy ultimately corrodes the glassy carbon emitter. It is probable that the presence of nickel in these alloys facilitates wetting the alloy to the glassy carbon substrate.

Longer source lifetimes are desired, and longer lifetimes can be achieved by utilizing alloys having lower melting points and operating the source at the minimum temperature required for ion extraction. The eutectics of the alloys mentioned above have melting points between 800° C. and 900° C., but at such temperatures metal source structures are rapidly attacked by the boron or nickel constituent. There exists the possibility of lower melting point alloys containing boron, but noen has yet been reported. There also exists the possibility of using alloys containing an ingredient which inhibits corrosion, but again none has yet been reported.

Consequently, there exists a need for an improved ion source for ion evaporation of boron from boron-containing alloys with relatively high melting points in the range of at least 800° C. to 900° C. The approach could involve modification of the source alloy, selection of a different material for fabricating the source structure, modification of the source structure, a combination of these approaches, or some entirely new technique. Whatever the technique chosen, it should allow the wetting of the source emitter and other components of the ion source contacted by the source metal, by a boron-containing source alloy without extensive corrosion of the source structure. No reaction between the source alloy and source structure should occur to modify the metallurgy of the source alloy. Finally, the technique should not require the operation of the source at greatly elevated temperatures for long periods of time when contacted with the alloy so that volatile componets, which may be present in the alloy, are evaporated. The present invention fulfills this need, and further provides related advantages.

SUMMARY OF THE INVENTION

The present invention provides a process for preparing a liquid metal ion source structure and a source structure wetted with a boron-bearing alloy, without introducing any substance not contained in the boron-bearing alloy. The invention is particularly useful in conjunction with carbon-containing substrates such as carbon, boron carbide, and boron enriched boron carbide, which themselves are otherwise desirable for fabricating source structures. The process does not require a particular source structure design, so that the source structure design is dependent only upon the material recommended and system requirements, not upon the wetting process. When using this approach, the boron-bearing alloy itself need not be subjected to high temperatures for any significant length of time, thus decreasing the likelihood that volatile constituents of the source alloy will be preferentially lost by atomic evaporation during the wetting process.

In accordance with the invention, a process for preparing a boronized ion source structure for use in ion beam evaporation of a boron-containing source alloy comprises the steps of furnishing an ion source structure substrate; coating the ion source structure substrate with boron to form a substrate-boron couple at the surface of the substrate; and heating the substrate-boron couple to a temperature of at least the interface solidus temperature of the graphite-boron couple for less than about ½ second, thereby forming a liquid layer at the interface of the couple. The ion source structure substrate so processed is typically composed of an emitter needle and associated reservoir made of graphite, although other substrate materials containing carbon or composed of another form of carbon may be so treated. In the preferred approach for contacting boron to the substrate, elemental boron powder is suspended in a volatile liquid carrier such as acetone to form a boron-containing mixture, and the boron-containing mixture is coated onto the surface of the ion source structure substrate. Afer drying, the coated substrate is heated in vacuum or a gaseous inert atmosphere to a temperature of about 2300° C. to 2450° C. for a very brief period of time, to melt the couple interface and thence the coating.

In a further aspect of the invention, a wetted liquid metal ion source structure for use in ion beam evaporation of a boron-containing source alloy is prepared by furnishing an ion source substrate; boronizing the ion source structure substrate; mixing free boron into the source alloy to form a boron-augmented source alloy mixture; and contacting the boron-augmented source alloy to the substrate at a temperature of at least the solidus temperature of the source alloy, whereby the boron-augmented source alloy wets the substrate. Some substrates must be boronized before the step of contacting. Once wetting is achieved, the flow of source alloy from the reservoir to the emitter tip continues under the effect of surface tension and other forces. In this process for preparing a wetted ion source structure, the step of boronizing, when necessary, preferably is accomplished by the process described previously, wherein the ion source element substrate is coated with boron to form a substrate-boron couple, the coated substrate is heated briefly to a temperature of at least the interface solidus temperature of the substrate-boron couple, and finally the substrate is quickly cooled to a temperature of less than the interface solidus temperature.

Graphite substrates typically must be boronized, though ordinarily, boron-containing substrates need not be boronized. In the process for preparing the wetted graphite source structure, the source alloy is preferably provided initially in powdered form, and the boron is also provided in powdered form. The two are mixed together, combined with a volatile liquid carrier vehicle such as acetone, and then painted or otherwise coated onto the surface of the previously boronized-graphite ion source structure substrate. The coated ion source structure substrate is then heated to a temperature of at least the solidus or melting temperature of the boron-containing source alloy, whereupon wetting is achieved.

Free boron is used as a wetting agent or flux when wetting boron-containing ion source alloys to ion source structure substrates which only partly contain carbon, i.e., boron carbide or boron-enriched boron carbide. These materials may not require prior boronizing. Instead, the boron-bearing alloy may be wet to the substrate in a manner similar to the second step used to secure the final wetting in the previously described process. Such a process comprises the steps of furnishing an ion source structure substrate; mixing elemental boron powder into the source alloy to form a boron-augmented source alloy; and contacting the boron-augmented source alloy to the substrate at a temperature of at least the solidus temperature of the source alloy, whereby the boron-augmented source alloy wets the substrate. Preferably, the boron-containing alloy, in powdered form, is mixed with a small amount of powdered, free boron; the mixture is suspended in acetone or some other volatile liquid carrier; and the mixture is painted or otherwise applied to the virgin surface of the substrate. The coated substrate is then heated to a temperature of at least the melting temperature of the boron-containing source alloy, whereupon wetting is achieved.

As will now be appreciated, the processes for preparing an ion source structure and a wetted ion source structure allow the ion structure itself to be boronized, if necessary, before contacting to the ion source alloy so that the modified source alloy will readily wet the ion source structure, thereby ensuring that the liquid metal ion source may be easily placed into operation when desired. For some structure substrates, boronizing is not required. In any case, the processes do not require that the ion source alloy be heated above its preferred ion evaporation temperature for any appreciable length of time, which would increase the risk of the loss of volatile constituents from the alloy. The process is applicable to ensure wetting of a variety of boron-containing alloys. Since boron is used to secure wetting and boron is contained in the ion source alloy, the boron content of the source alloy may be initially modified so that any boron added in the wetting process will make up the difference, so that the exact composition of the ion source alloy may be maintained or altered with ease. Other features and advantages of the present invention will become apparent from the following more detailed description, taken in conjunction with the accompanying drawings, which illustrate, by way of example, the principles of the invention.

BRIEF DESCRIPTION OF THE DRAWINGS

FIG. 4 is a further enlarged cross-sectional view of a portion of an emitter needle substrate, before (4*a*) and after (4*b*) heating to boronize the substrate to the "ideal" condition;

FIG. 5 is a view subsequent to that shown in FIG. 4 showing before (5*a*) and after (5*b*) heating in the final wetting step employing a boron-augmented alloy;

DESCRIPTION OF THE PREFERRED EMBODIMENT

Figure 1:
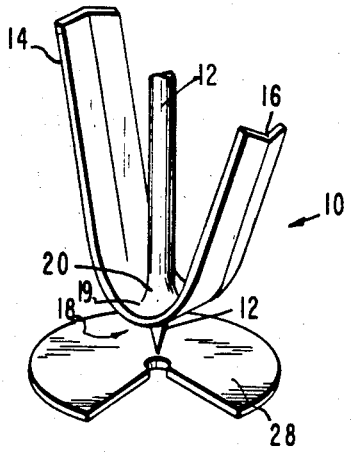
FIG. 1 is a perspective view of one type of liquid metal ion source structure.

The present invention relates to a liquid metal ion source, indicated generally by the numeral 10 in FIG. 1. The ion source 10 includes an ion evaporation substrate needle 12 typically having a tip radius of less than about 20 micrometers and an apex half angle of less than about 49.3°, which extends through a hole (not shown) at the lower end of a generally U-shaped heater element 14. The heater element 14 is in the form of a U-shaped ribbon which may incorporate an embossed crease 16 in each leg to increase the columnar strength of the heater element 14. If used, the crease 16 approaches the apex bend 18 of the heater element but does not enter the region of the apex bend itself. If ion source alloy (in powdered, chip or otherwise divided form) is placed in the apex bend 18 of the heater element 14 and current, produced by a voltage $V_H$, is passed through this heater element 14, the alloy will melt and naturally form a reservoir 19 of liquid metal in the apex bend 18 of the heater element 14. The reservoir 19 remains anchored in the apex end 18 under the influence of gravity because surface tension tends to minimize the miniscus 20 of liquid metal and is wetted to it.

The needle 12 then passes through a non-circular hole in the heater element (not shown) so designed as to allow liquid metal to flow to a needle tip 22 yet still retain the needle 12. In proper operation of the ion source 10, heating of the heater element 14 melts the metal in the reservoir 19 to wet the inner surface of the apex bend 18 of the heater element 14. The molten metal conducts heat to the needle 12, causing it to wet with the metal, which ultimately flows to the needle tip 22.

Figure 2:
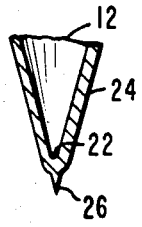
FIG. 2 is an enlarged cross-sectional view of a detail of FIG. 1, illustrating the point of the emitter needle.
Figure 3:
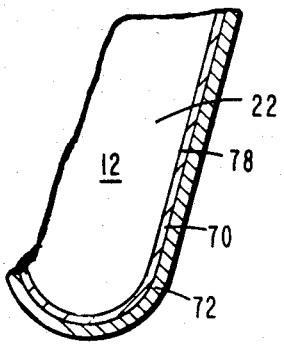
FIG. 3 is a further enlarged cross-sectional view of an emitter needle tip illustrating the coating layer thereon.

Referring to FIG. 2, the liquid ion source metal flows from the reservoir 19 located in the apex bend 18 toward the tip 22 of the needle 12, forming a liquid layer 24 along the tip 22 of the needle 12. At the very tip 22 of the needle 12, where the liquid layers 24 from the sides of the needle 12 meet, the action of an applied external electrostatic field, from an extraction electrode 28, draws the liquid layers 24 downwardly to form a cusp 26, which serves as the actual emitter point for the ion source 10. That is, the ions emitted by the ion source 10 are preferably emitted only from the cusp 26, located on the extreme end of the needle tip 22, so that ions appear to emanate from a point source of extremely small dimensions. Positively charged ions are drawn from the cusp 26 by an electrostatic field set up between the ion source 10 and extraction electrode 28 through the application of a voltage $V_E$. Ions leave the cusp 26 and pass through a hole 27 in the extractor electrode 28. With this configuration, the current density of emitted ions at the cusp 26 can be very large, typically on the order of $10^4$ amps per square centimeter per steradian.

The liquid layer 24 must flow from the reservoir 19 located in the apex bend 18 down the surface of the needle 12 to the cusp 26, for emission to be initiated and sustained. However, it is often difficult to initiate and sustain a flow of metal from the reservoir 19 and it is also sometimes difficult to initiate and sustain a wetted flow of source metal in the layer 24 along the needle 12, because of difficulty in wetting the alloy to the substrate.

Figure 6:
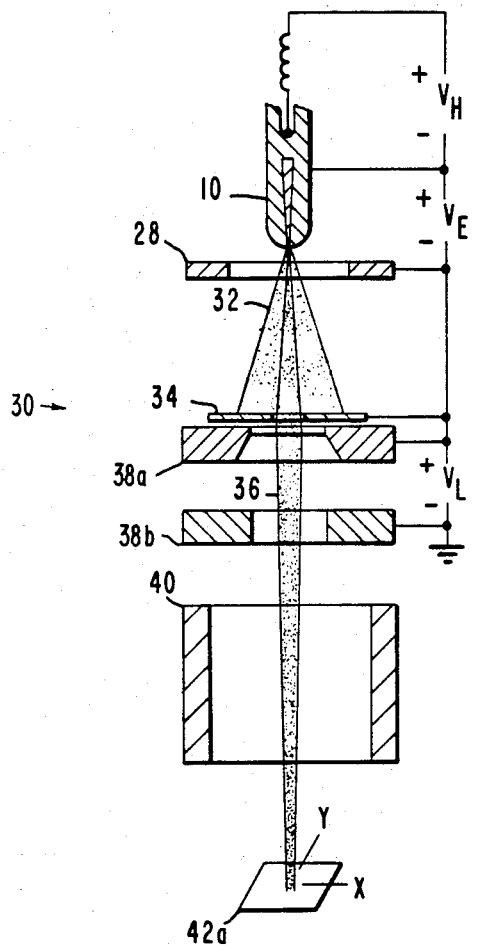
FIG. 6 is a schematic sectional side view of a scanning ion probe employing a liquid metal ion source.

FIG. 6 illustrates one important application of the use of liquid metal ion sources of the type illustrated in FIGS. 1 and 2. The ion source 10 is mounted in a scanning ion probe 30. The extraction electrode 28, which is negatively biased with respect to the needle 12 by the voltage $V_E$, draws ions out of the cusp 26, to form an ion beam 32. A small portion of this beam (typically 1 milliradian) is allowed to pass through an aperture 34 into the optics section of the instrument itself. A transmitted beam 36 emerging from the aperture 34 is passed through accelerating electrodes 38 which increase the energy of the beam 36, as the second accelerating electrode **38*b* is negatively biased with respect to the first electrode 38*a* by a voltage $V_L$. The converging beam 36 then passes through electrostatic deflection electrodes 40 wherein the beam is deflected from side to side to move in a scanning fashion across the surface of a target 42*a*. The transmitted beam 36 can then be used to write various patterns upon the surface of the target 42*a*** in the form of ion-implanted zones of controllable shape and type. The beam may also be used to ion machine very narrow grooves or very small holes. Through the incorporation of a secondary electron detector, the beam may be used to image the target in a fashion similar to that of a scanning electron microscope. Finally, through the incorporation of a secondary ion mass spectrometer, the microcomposition of very small regions located on the target may be analyzed in both a qualitative and quantitative manner.

Not all elements used as dopants in ion implantation can be used in their unalloyed form in the source metal of a liquid metal ion source. For example, boron and arsenic are two valuable dopants which cannot be ion evaporated in vacuum at their melting points. In both cases, the elements have to be combined with one or more elements to form an alloy, preferably a eutectic, with a greatly depressed melting point. Boron, having a melting point of about 2300° C., may be combined with the appropriate amount of platinum, to yield a eutectic having a melting point of less than 800° C. More importantly, the boron-platinum eutectic may be melted in a vacuum without either of the constituents evaporating by an atomic evaporation mechanism. The boron-platinum eutectic may be used in a liquid metal ion source made of a substrate material which does not react significantly with the eutectic, as a source of boron ions for implantation. When ions are extracted from an alloy of this eutectic composition, the boron and platinum ions evaporate in eutectic stoichiometric proportions, so that the melting point remains fixed. Once the stoichiometric alloy is extracted, the desired dopant ion species must be separated from all other ion species, so that only the desired ion species is implanted in the target **42*a***.

Figure 7:
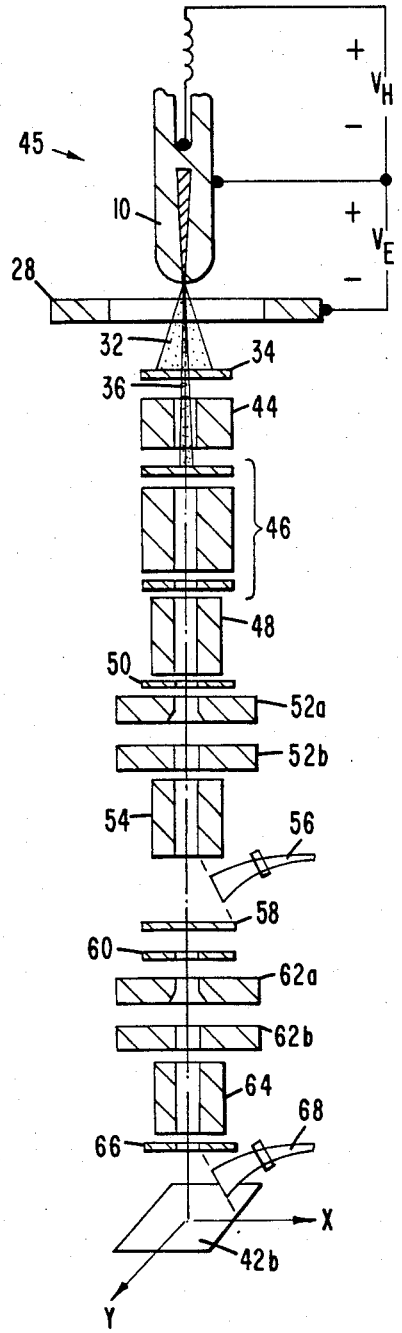
FIG. 7 is a schematic sectional side view of an ion implant probe employing a liquid metal ion source.

A modification of the ion probe 30 has been developed to allow implantation from such alloys. An ion implant probe 45, as shown in FIG. 7, differs from the probe 30 in that it incorporates a Wein velocity filter 46 which acts as a mass separator, because of the very low energy spread of the beam obtained from a liquid metal ion source when properly operated. To provide adequate longitudinal space for the filter 36 and keep the ultimate spot size small yet achieve a high final acceleration voltage, two additional lens and miscellaneous intermediate apertures and octupole deflectors are provided.

Referring to FIG. 7, the implant probe 45 resembles the probe 30 above the first aperture 34. An Einzel lens 44 is located immediately below the aperture 34 to transfer a narrow, relatively low energy beam 36 an appreciable distance downstream, The Wein filter 46 is placed between the Einzel lens 44 and its ultimate point of focus—near a separator aperture 50. The mass filter 46 operates with a minimal magnetic and electrical field because the beam energy is moderate. Any introduced aberations are therefore small. The beam is separated into ion species with the desired species positioned on the separator aperture 50 by the adjustable electric field in the filter 46. Thereafter, the beam is transferred and accelerated through the final two pairs of lens (52*a* and *b*, 62*a* and *b*) and ultimatley brought to a final focus on the target 42*b*. Two intermediate octupole deflectors 48 and 54 position the beam along the optical axis, and a final octupole deflector 64 manipulates the beam across the target 42*b* for implanting of devices. A plurality of various apertures, 50, 60 and 66 remove all extraneous rays of ions. An intermediate alignment target 58, which may be rotated out of the beam, is used to align the beam initially. Both targets 42*b* and 58 may be imaged by respective secondary electron amplifiers 68 and 56.

In accordance with a preferred embodiment of the present invention, the preparation of a wetted ion source structure begins by furnishing an ion source structure substrate. For purposes of illustration, the emitter tip portion 22 of the structure 10 is used as an example of such a substrate. The physical shape and size of the substrate 22 is unmodified from what would be otherwise used, if the boronizing treatment were unnecessary.

For ion evaporation of boron-containing source alloys, the substrate 22 is preferably made of graphite. Graphite is not corroded by boron-containing alloys at temperatures of at least 1400° C.; indeed, the reaction is so poor that the alloys will not wet graphite directly. Very pure graphite is inexpensive. Graphite is easily machined into complex shapes with very delicate features. Graphite has superior mechanical characteristics at high temperature. Finally, the electrical characteristics of graphite at high temperature are good.

Subsequent processing involves the coating (by means of boronization) of a relatively thin layer 70 onto the substrate 22 and then wetting a boron-augmented alloy 72 to the layer 70. The initial boronization coating does not substantially change the shape of the substrate 22, but does increase its dimensions very slightly.

Referring to FIG. 4*a*, a layer 74 of boron is coated onto the needle 12 so as to adhere to the substrate at an interface 78. Preferably, the boron is provided as −325 mesh powdered red boron, although similarly powdered metallic boron has been used successfully. The powdered boron is stirred into a liquid vehicle carrier which allows the boron to be brushed, sprayed, or otherwise applied to a surface. The preferred liquid vehicle carrier is acetone, although other liquids may be utilized, as long as the liquid may be fully evaporated in subsequent processing so that no resident of the liquid remains on the surface. Liquids which leave a carbon residue when heated are highly unsatisfactory. The boron is added to the carrier in an amount sufficient to achieve a viscosity consistent with the application method. For example, the mixture should have the viscosity of light machine oil if it is to be brushed onto the substrate.

Prior to the actual coating of the substrate, it is preferred practice to clean the needle 12 by outgassing in vacuum at about 1000° C. for several minutes. Thereafter, the substrate should be handled carefully so as not to contaminate the substrate surface.

The liquid mixture of powdered boron in the vehicle carrier is next applied to the substrate 12 whose surface is to be "boronized", the generic term applied to this preparation procedure. Preferably, the boron-vehicle carrier mixture is brushed onto the surface of the substrate. The boron could also be applied by other procedures, such as a chemical reaction which would leave the boron in place on the surface, or a procedure wherein boron is directly deposited onto the surface, such as evaporation or electrodeposition. No limitation on the thickness of the layer of boron 74 (after evaporation of the liquid vehicle carrier) is known, but experience has shown that for a substrate that is to be ultimately fired in vacuum, a thickness of about 100 micrometers is preferred. If the coating 74 is too thick, it may separate from the substrate during heating. If a first application of the boron-vehicle carrier liquid does not produce the desired coating thickness, reapplication can occur until the preferred thickness is built up. The coating of the boron layer 74 onto the surface of the substrate 12 forms a substrate boron couple at the interface 78 after the liquid carrier is evaporated. In any case, however, adsorbed nitrogen, schematically illustrated at numeral 76, is present in the boron layer 74 and porous substrate needle 12.

The substrate-boron couple is then heated to at least the interface solidus temperature of the substrate-boron couple, thereby forming a liquid layer at the interface of the couple. Preferably the heating is accomplished resistively by passing an electrical current through the substrate, or through the use of electron bombardment heating, or a combination of the two. Both methods allow a very rapid heating and cooling, with a short residence time at temperature. The substrate may be heated in vacuum or an inert gas atmosphere. As will be appreciated, if an inert gas atmosphere is used, electron bombardment heating cannot be employed.

The exact structure of the layers formed at the surface of the substrate needle 12 after heating and subsequent cooling to ambient temperature is not known with certainty. Without wishing to be bound by this possible explanation and proposed structure, it is believed that the structure is as illustrated in FIG. 4*b*. A thin reaction zone 80 surmounting the substrate needle 12 is composed of boron carbide 82 and boron-enriched carbides 84, schematically illustrated in FIG. 4*b*. This zone 80 acts to seal in carbon in the substrate 22, preventing it from diffusing outwardly in subsequent reheatings at reduced temperatures. Also within this zone 80 is boron nitride 86, resulting from the reaction of boron 74 with adsorbed nitrogen 76. Proceeding further outwardly, the level of dissolved carbon 88 and boron nitride inclusions 86 progressively decreases, and a greater proportion of fused boron 90 is encountered, until at the surface, the composition is nearly pure fused boron. The fluxing action of the fired boron coating is thus apparent. Both carbon and nitrogen, which in themselves inhibit alloy wetting, are tied up as boron carbides 82 and 84 and boron nitride 86, and left buried within a coating whose surface is nearly pure fused boron. Furthermore, the substrate 12 is completely coated with a zone 80 which inhibits the outward diffusion of carbon. The zone 80 forms a strong bond with substrate needle 12, so that the coating does not separate from the substrate during subsequent thermal cycling.

The substrate-boron couple shown in FIG. 4*a* should be heated to a temperature at least as great as the interface solidus temperature, which as used herein is the temperature at which a liquid first forms at the interface of a couple between two different materials upon heating of the couple. When two materials are placed together to form a couple and then heated, the phase diagram of the binary or higher order couple shows that, upon heating, a liquid appears at some temperature which is ordinarily different from that of the melting point of either of the materials making up the couple. The solidus temperature is the temperature at which, upon heating, molten material first appears. The interface solidus temperature is then the temperature at which molten material appears upon heating, at the interface between the two components of the couple. Because the boron layer 74 is initially very thin, on the order of 1–10 micrometers, usually the entire thickness of the coated layer is melted at about, or just above, the interface solidus temperature.

The interface solidus temperature for any particular substrate-boron couple is determined by the substrate selected. The preferred substrate for use in constructing ion sources for the ion evaporation of boron-containing alloys is graphite. The maximum heating temperature required for boronizing graphite is from about 2300° to about 2450° C., the approximate respective melting points of boron and boron carbide. Interface melting does not occur at lower temperatures, while at higher temperatures several detrimental processes occur. At higher temperatures, undesirably large amounts of boron carbide are rapidly formed. Carbon rapidly dissolves into the molten boron layer, and boron and boron carbide rapidly evaporate (in vacuum).

The couple shown in FIG. 4 must not be at the maximum temperature for too long a period of time. For times greater than about ½ second, too much boron is evaporated from the substrate to achieve a proper surface upon cooling. Thus, the substrate is "flashed" to the temperature range of about 2300° C. to 2450° C., for less than about ½ second to achieve the desired final coated substrate.

The heating may be accomplished either in a vacuum or in an inert gas atmosphere. If the heating is done in a vacuum, the operation must be completed quickly to prevent evaporation of boron. Heating is therefore preferably done in a high purity inert gas atmosphere, which suppresses the volatile loss of boron and also prevents the introduction of impurity atoms into the substrate coating.

The boronized ion source structure is then cooled to ambient temperature for storage or to be immediately readied for the final wetting process, as will be described next. The boronizing process produces the boron-rich surface 90 which is readily wetted by the boron-containing alloy.

The thicker regions of an ideally boronized surface have the appearance of crazed glass when viewed in a scanning elecron microscope at 150× magnification. Irregular, polygon shaped regions, perhaps crystalline in nature, with dimensions ranging from 20 to 150 micrometers are typically observed. At 1500× magnification, the interstices between polygon shaped regions are seen to be filled with another material of a different phase, and the typical width of these interstices is 1.5 microns. The thinner regions of an ideally boronized surface viewed at 1500× magnification have a glassy appearance which is seen to contain fissures or striations less than 0.5 micrometers wide.

If too little powdered boron 74 is initially applied in too thin a layer, or the boron-substrate couple is maintained at the maximum temperature for too long a time and a major portion of the boron is evaporated from the layer 90, the resulting coating, termed a "light" coating, has a frosty appearance and is thinner than the ideal coating. When viewed in a scanning electron microscope at 3000× magnification, the surface appears to be composed of 5 to 10 micron, jumbled glassy platlets bound together by bridges of the same material. The surface of the platlets resembles the general glassy appearance of the more amorphous coating of the thinner portions of the ideal coating.

If any overly thick layer of powdered boron 74 is initially applied to the substrate and the couple is heated above about 2450° C., or the couple is held at a temperature greater than about 2300° C. for too long a period of time, or subsequent coatings of powdered boron are fired to an initially applied coating, then carbon dissolves into the zone 80 in large quantities and boron is lost. The resultant "heavy" boronization coating includes carbon rich islands of boronization surrounded by regions of light boronization.

Of the three types of boronization, the boronization termed "ideal" is strongly preferred for securing the ultimate wetting of the ion source alloy. The "ideal" coating is the most difficult to achieve, and should be formed on the first firing. An attempt at refining a light or heavy coating to make it ideal is unlikely to succeed, due to the irreversible diffusion reactions. Wetting may be done to a lightly boronized substrate, but the wetted alloy does not spread over the surface as well as in the case of an ideally boronized substrate. Heavy boronization is least preferred, and sometimes cannot be wetted by the boron-containing source alloy.

In accordance with a further aspect of the invention, a wetted ion source structure 10 may be formed by first furnishing an ion source structure substrate, and boronizing the substrate, preferably to an "ideal" condition by the previously described approach. Referring to FIG. 5, the source alloy to be applied to the boronized source structure substrate is prepared by mixing a small amount of free boron into a selected boron-containing powdered alloy to form a boron-augmented source alloy mixture, and then this boron-augmented source alloy mixture is contacted to the boronized substrate at a temperature of at least the solidus temperature of the source alloy, to wet the boron-augmented source alloy mixture to the boronized substrate, as illustrated in FIG. 5*b*.

The boronizing operation is preferably accomplished by the process described previously for preparation of an ion source structure preferably made of graphite. The boronized substrate may be prepared either immediately prior to the following steps, or at some earlier time.

In the preferred process, the boron-augmented source alloy is prepared from −325 mesh powdered boron and powdered alloy. The alloy itself may be made deficient in boron so that when it is augmented with free boron, the final composition of the alloy, after firing, approaches a desired or optimal composition—usually a eutectic or a near-eutectic, slightly boron-deficient alloy. The added boron serves as a fluxing agent and also an alloy constituent. The process of the present invention has the important advantage that no extraneous impurity element need be introduced into the source alloy to accomplish fluxing. The source alloy itself contains as a constituent the fluxing material, boron, and the addition of elemental boron does not add any new element. However, the total boron content of the alloy may be altered by varying the ratios of boron and source alloy powders. In this way, the overall composition of the boron-augmented source alloy may be adjusted to a desired level which is determined by the specific application.

The use of more than about 3% elemental boron by weight added to the boron-augmented source alloy gives less desirable results. Improved wetting and spreading occurs with the addition of less than about elemental 3% boron by weight. Exceptionally good wetting and spreading occur when approximately 1% boron is added. As little as about 0.5% elemental boron by weight has been found effective. The final boron-augmented source alloy is preferably eutectic or slightly boron deficient. Alloys having excess boron tend to precipitate boron on cooling. Typically, an ion source is heated slightly above the melting point of the source alloy, used for a period of time such as 8 hours and then cooled. This cyclical pattern occurs many times in the life of a typical ion source. When the ion source is reheated and the alloy remelted, some but not all of the precipitate dissolves. When the ion source is cooled again, precipitation occurs except that the precipitation occurs preferentially at sites where previous precipitates have not totally dissolved. After several thermal cyclings, large precipitates evolve which give the coating a lumpy character. If the precipitates build up on the ion source emitter (needle tip), the seat of ion formation may shift from one precipitate to another, preventing proper focussing of the ion beam.

The same source alloy may be prepared in constituent form, or as a mixture of boron and a metal or metals in the proper ratio. Additional free, elemental boron could then be added, or the boron constituent of the alloy itself could be used as the flux. This approach is not preferred, as the firing temperature is typically higher than when a previously fused alloy in powdered form is used.

A layer of the born-augmented source alloy 98 is then contacted to a boronized layer 91 of the substrate needle 12 at the interface 94, by any suitable technique. In the preferred process, the powdered boron-augmented alloy mixture is mixed into a liquid vehicle carrier and then painted onto the previously boronized substrate, forming an interface at 94. The liquid vehicle carrier is preferably acetone, but other volatile liquids may be utilized as long as the liquid totally evaporates before subsequent firing so that no carbon residue remains. The boron-augmented alloy mixture is added to the liquid carrier in an amount sufficient to achieve the desired consistency for application. When the mixture is to be painted onto the surface, its viscosity should be comparable with that of light machine oil. The mixture must be kept continually mixed to prevent segregation of the boron fraction.

The painting of the powdered boron-augmented source alloy onto the surface 94 of the boronize substrate allows the application or a uniform coating over the entire surface, which will wet upon heating. No advantage is gained by coating the boronized substrate with a molten mixture of boron-augmented source alloy by, for example, a step of dipping. The boron must exist in a free form, since some adsorbed nitrogen 76 exists within the applied powder mixture and on the surface 94 of the boronization layer 91. The free boron mixed with the boron-containing source alloy helps to react with the nitrogen during heating so that the nitrogen is removed or buried in the form of boron nitride.

Again referring to FIG. 5, after applying the powdered boron-augmented source alloy mixture to the boronized layer 91 of the substrate 12, the boronized substrate 91 is then heated to a temperature of at least the solidus temperature of the source alloy to melt the source alloy layer powder, whereupon the boron-augmented source alloy 98 wets the boronized substrate. After the liquid surface is established, or simultaneously with its establishment, the wetted ion source structure may be contacted to a pool or other reservoir of source alloy which has not been boron-augmented. The process of dipping the prewetted source structure into pure alloy replenishes alloy on a source depleted of alloy through normal ion emission. Initially, however, the final step of wetting boron-augmented alloy to the boronized source structure provides adequate alloy for running the source so that ion evaporation may proceed.

The temperature to which the ion source structure is heated to accomplish the wetting depends upon the composition of the source alloy and the length of time the alloy is held at this temperature. Typically, the temperature is on the order of about 1100° C. to 1600° C. for holding periods of less than about one minute. The temperature must be sufficiently great to exceed the solidus temperature of the source alloy, so that adequate spreading of the boron augmented alloy occurs. The use of moderately greater temperatures is not detrimental, and accelerates the wetting process. The time of exposure is inversely related to temperature. A lower temperature requires a longer holding time and vice versa, for the same degree of wetting and spreading to occur. On the other hand, the upper temperature should not exceed a temperature at which a substantial evaporation of a volatile constituent of the source alloy occurs. Such volatilization of a source alloy component tends to defeat the wetting process, and may even cause a dewetting of the source alloy from the substrate.

When the wetting is complete, the resultant structure and composition of the entire coating on the substrate needle 22 is not known with certainty, but the most probable structure is portrayed in FIG. 5*b*. While not wishing to be bound by this possible explanation, it is believed that the surface 102 of the original boronization layer 91 is probably of high boron content, so that boron from this layer 91 diffuses upwardly into a liquid alloy layer 100. Similarly, the metal constituents of the alloy layer 100 diffuse downwardly into the layer 91. The dissolved carbon 88 in the boronization layer 91 diffuses upwardly into the alloy layer 100. The layers 91 and 100 thus interdiffuse so that the composition changes over time. This change has been observed through mass spectra analysis of a running ion source and Auger analysis of test substrates. After approximately 12 hours an equilibrium is reached so that the composition no longer changes.

In accordance with a further aspect of the invention, ion source substrate materials other than graphite, which contain carbon as a partial ingredient, may be wetted through the use of boron as a wetting agent or flux without prior boronizing of the substrate. These materials include boron carbide and boron-enriched boron carbide. For both these substrate materials, boronization is not required. It is believed that the boron in these substrates previously bonds with the carbon to limit diffusion and most probably with any nitrogen to remove it as a wetting deterrent.

For these substrates, boron-augmented source alloy is applied to the untreated substrate and heated to a temperature in the range of about 1100° to about 1600° C., depending upon the amount of carbon present in the substrate. Although wetting to these carbon-based materials is made more simply by their boron content, they each have drawbacks which make graphite the preferred substrate material. They are difficult to machine, are difficult to make and consequently more expensive than graphite, are more brittle than graphite, especially at high temperature, and have different electrical and heat conduction properties which make their use at high temperature difficult.

The following examples will serve to illustrate aspects of the invention, but should not be taken as limiting the invention in any respect.

EXAMPLE 1

An attempt was made to wet a pure powdered source alloy of 30 atomic percent boron—70 atomic percent platinum to an unboronized Poco graphite substrate. Wetting could not be achieved at temperatues as high as 3000° C.

Wetting of the alloy was to the substrate achieved by first boronizing the substrate to an "ideal" condition for less than ½ second at 2400° C., by the procedure described previously. The powdered source alloy was mixed with between 1 and 3% weight percent elemental red boron, suspended in acetone, and painted onto the substrate in a thickenss of about 100 micrometers. The painted, boronized substrate was resistively heated to about 1400° C. for about 10 seconds, and complete wetting was observed.

EXAMPLE 2

An attempt was made to wet a pure powdered source alloy of 53 atomic percent nickel—47 atomic percent boron to an unboronized Poco Graphite substrate. Wetting could not be achieved at 1400° C. during a 25 second exposure.

Excellent wetting and spreading were achieved by first boronizing the substrate to the "ideal" condition at 2340° C. with 1-3% elemental red boron, suspended in acetone, and painted onto the substrate in a thickness of about 100 micrometers. The painted, boronized substrate was heated to 1540° C. for about 15 seconds, and complete wetting and spreading of the alloy were observed.

EXAMPLE 3

An attempt was made to wet a pure powdered source alloy of 20 atomic percent boron, 40 atomic percent palladium, 40 atomic percent nickel to an unboronized Poco graphite substrate. Wetting could not be achieved at 1400° C. during a 5 second exposure.

Wetting was achieved by first boronizing the substrate to the "ideal" condition at 2400° C. for less than ½ second. The powdered source alloy was mixed with 1 weight percent elemental red boron, suspended in acetone, and painted onto the substrate to a thickness of about 100 micrometers. The painted, boronized substrate was heated to about 1400° C. for about 30 seconds and excellent wetting and spreading were observed.

EXAMPLE 4

A Poco graphie substrate was boronized to the "ideal" condition at 2470° C. for less than ½ second. A powdered source alloy of composition 10 atomic percent boron, 10 atomic percent arsenic, 40 atomic percent palladium, and 40 atomic percent nickel was mixed with 1 to 3 percent elemental red boron, suspended in acetone, and painted onto the substrate to a thickness of about 100 micrometers. The painted, boronized substrate was heated to about 1160° C. for about 15 seconds, and good wetting and some spreading were observed. In this case, the wetting temperature was minimized to prevent the evaporation of arsenic, and no arsenic evaporation was observed.

EXAMPLE 5

A series of tests were performed to evaluate the relative wetting effectiveness of various combinations of substrate and source alloy treatments. The nickel-boron source alloy of Example 2 was used, both with and without the 1 to 3 weight percent boron addition. Several Poco graphite substrates were used, both with and without a boronized surface. In one instance, a lightly boronized surface was achieved by holding the substrate at a temperature of 2450° C. for more than ½ second. The following table ranks the effectiveness of wetting and spreading:

| Results | Substrate Boronizing | Boron Flux Added to Alloy |
|---|---|---|
| No wetting | None | None |
| Some wetting | None | 1-3 wt. % |
| Good wetting, no spreading | "ideal" | None |
| Some wetting, some spreading | "light" | 1-3 wt. % |
| Excellent wetting and spreading | "ideal" | 1-3 wt. % |

EXAMPLE 6

A sample of stoichiometric boron carbide was obtained from Eagle-Picher Corp. and machined into several test substrates.

No wetting was observed when the pure boron-platinum alloy of Example 1 was contacted to a non-boronized substrate and heated in stages to 3000° C.

Excellent wetting and spreading were observed when a layer of powdered boron flux was first painted onto the substrate, the alloy in chunk form was placed on top of this coating, and the substrate was heated to 1600° C. for several seconds.

EXAMPLE 7

A boron-enriched, boron carbide sample was obtained from Eagle-Picher Corp. and machined into several test substrates. The boron/carbon ratio of this sample was reported by the manufacturer to be about 10/1 to 20/1.

No wetting was observed when the pure boron-platinum alloy as used in Example 1 was contacted to the substrate and heated to 1400° C. for approximately one second.

Excellent wetting and spreading were observed when 1 to 3 weight percent of powdered elemental red boron was mixed with pure powdered eutectic boron-platinum alloy, contacted with the non-boronized substrate, substrate, and heated to 1400° C. for approximately 10 seconds.

EXAMPLE 8

A liquid metal ion source was prepared using the boron-platinum source alloy of Example 1. A Poco graphite source structure was boronized by heating to approximately 2450° C. for ½ second, in vacuum through a combination of resistive and electron bombardment heating. A lightly boronized surface resulted. The eutectic source alloy with about 1–3 weight percent boron added was contacted to the boronized source structure and heated to 1200° C. to 1400° C. for about 30 seconds to achieve wetting and some spreading. The wetted source structure was successfully operated as a liquid metal ion source, and ion emission was observed.

EXAMPLE 9

Example 8 was repeated with the nickel-boron alloy of Example 2. The finished liquid metal ion source was life tested for 7 hours with periodic mass spectrometic analysis. Emission of boron gradually increased over this period to nearly the stoichiometric value of boron contained in the eutectic.

EXAMPLE 10

The substrates prepared in Examples 1 and 2 were independently tested for a period of time in excess of 100 hours at a sustained temperature greater than the melting point of the respective alloys. In both cases, the alloys remained molten, the surface boron content stabilized after approximately 12 hours, spreading improved, and there was no indication of dewetting.

As can now be appreciated, the process of the present invention provides a source structure and wetted ion source structure for use in liquid metal ion sources. The surface of an ion evaporation source substrate is first boronized in the preferential case where the substrate is made of graphite, to wet the surface with the desired source alloy. The use of boron does not add any additional element into the source alloy since boron is contained in the ion source alloy. Wetting of the source alloy to the boronized substrate is accomplished by adding a small amount of elemental boron to the source alloy, and then contacting the boron-augmented source alloy to the boronized substrate. Once again, no additional element is added to the source alloy. Because the wetting agent is boron and boron is contained in the alloy, composition adjustments can easily be made so that the final composition of the wetted alloy is that desired. The process is readily adaptable to use in liquid metal ion sources made of graphite and with some slight modification, to those made of boron containing carbon based substrates.

Although a particular embodiment of the invention has been described in detail for purposes of illustration, various modifications may be made without departing from the spirit and scope of the invention. Accordingly, the invention is not to be limited except as by the appended claims.

What is claimed is:

1. A process for preparing a boronized ion source structure for use in ion beam evaporation of a boron-containing source alloy from an ion beam source, comprising the steps of:

furnishing an ion source structure substrate;

coating the ion source structure substrate with boron to form a substrate-boron couple at the surface of the substrate; and heating the substrate boron couple in a vacuum or inert atmosphere to a temperature of at least the interface solidus temperature of the substrate-boron couple for less than about one minute thereby forming a liquid layer at the interface of the couple.

2. The process of claim 1, wherein said ion source structure substrate is formed of a material selected from the group consisting of graphite, boron carbide, and boron-enriched boron carbide.

3. The process of claim 1, wherein said steps of coating includes the substeps of:

suspending elemental boron powder in a liquid carrier vehicle to form a boron-containing mixture; and coating the boron-containing mixture onto the surface of the evaporation substrate.

4. The process of claim 1, wherein said step of heating is accomplished in a vacuum.

5. The process of claim 1, wherein said step of heating is accomplished in a gaseous inert atmosphere.

6. The process of claim 1, wherein the maximum temperature in said step of heating is about 2300° C. to about 2450° C.

7. The process of claim 1, wherein the ion source structure includes a needle emitter.

8. An ion source structure prepared by the process of claim 1.

9. A process for preparing a wetted ion source structure for use in ion beam evaporation of a boron-containing source alloy from an ion beam source, comprising the steps of:

furnishing an ion source structure substrate;

mixing elemental boron powder into the powdered source alloy to form a boron-augmented source alloy; and contacting the boron-augmented source alloy to the substrate in a vacuum or inert atmosphere at a temperature of at least the solidus temperature of the source alloy for less than about one minute, whereby the boron-augmented source alloy wets the substrate.

10. The process of claim 9, including the further step, prior to said step of contacting of:

boronizing the ion source structure substrate.

11. The process of claim 10, wherein said step of boronizing includes the substeps of:

coating the ion source structure substrate with boron to form a substrate-boron couple at the surface of the substrate;

heating the coated substrate to a temperature of at least the interface solidus temperature of the substrate-boron couple for less than ½ second, thereby forming a liquid layer at the interface of the couple; and cooling the substrate to a temperature of less than the interface solidus temperature of the substrate-boron couple.

12. The process of claim 11 wherein said ion source structure substrate is formed of a material selected from the group consisting of a boron carbide and boron-enriched boron carbide.

13. The process of claim 11, wherein said step of coating includes the substeps of:

suspending elemental boron powder in a liquid carrier vehicle to form a boron-containing mixture; and applying the boron-containing mixture to the surface of the ion source structure substrate.

14. The process of claim 9, wherein the temperature reached in said step of contacting is from about 1100° C. to about 1600° C.

15. The process of claim 9, wherein the source alloy is selected from the group consisting of boron-platinum, boron-nickel, boron-palladium-nickel, and boron-arsenic-palladium-nickel.

16. The process of claim 9, wherein said step of contacting includes the substeps of:

furnishing a mixture of powdered boron and powdered source alloy;

suspending the mixture in a liquid carrier vehicle to form a boron-containing source alloy mixture, coating the boron-containing source alloy mixture onto the substrate to form a coated substrate; and heating the coated substrate to a temperature of at least the melting temperature of the boron-containing source alloy mixture.

17. A wetted source structure prepared by the process of claim 9.

* * * * *